United States Patent [19]

Bensley

[11] Patent Number: 4,586,209

[45] Date of Patent: May 6, 1986

[54] METHOD OF MAKING FOOTWEAR

[76] Inventor: Douglas W. Bensley, 100-1385 Commissioners Rd. West, London, Ontario N6K 1E2, Canada

[21] Appl. No.: 405,443

[22] Filed: Aug. 5, 1982

Related U.S. Application Data

[63] Continuation-in-part of Ser. No. 148,611, May 12, 1980, Pat. No. 4,343,057, which is a continuation-in-part of Ser. No. 100,586, Dec. 5, 1979, Pat. No. 4,326,313.

[51] Int. Cl.[4] ..... A43D 9/00; A43B 13/18; A43B 3/24

[52] U.S. Cl. ..... 12/142 D; 12/142 T; 36/15; 36/12; 36/11.5

[58] Field of Search ..... 36/101, 15, 12, 19.5, 36/17 PW, 33, 11.5; 12/142 D, 142 RS, 142 T

[56] References Cited

U.S. PATENT DOCUMENTS

| | | | |
|---|---|---|---|
| 2,092,533 | 9/1937 | Hyde | 36/11.5 |
| 2,146,805 | 2/1939 | Engel | 36/11.5 |
| 2,160,377 | 5/1939 | Bain | 36/11.5 |
| 2,214,791 | 9/1940 | Kamborian | 36/11.5 |
| 2,368,314 | 1/1945 | Marx | 36/15 |
| 2,519,108 | 8/1950 | Bryant et al. | 36/101 |
| 2,552,943 | 5/1957 | Danielius | 36/101 |
| 2,760,279 | 8/1956 | Jones et al. | 36/15 |
| 2,761,224 | 9/1956 | Gardiner | 36/15 |
| 3,204,346 | 9/1965 | Lockard et al. | 36/15 |
| 4,343,057 | 8/1982 | Bensley | 12/142 D |
| 4,369,537 | 1/1983 | Midgley | 12/142 S |
| 4,439,935 | 4/1984 | Kelly | 36/11.5 |

FOREIGN PATENT DOCUMENTS

| | | | |
|---|---|---|---|
| 1071512 | 9/1954 | France | 36/11.5 |
| 1142106 | 9/1957 | France | 36/11.5 |

*Primary Examiner*—Werner H. Schroeder
*Assistant Examiner*—Steven N. Meyer
*Attorney, Agent, or Firm*—Robert F. Delbridge; Arne I. Fors

[57] ABSTRACT

A method of making an article of footwear includes attaching a connecting strip to forward and rearward portions of the upper on the uppers medial and lateral sides. A sole is provided having recesses adjacent the medial and lateral sides. The footwear is assembled by movement of the connecting strips in a direction perpendicular to their length and into the sole recesses. The connecting strips may alternatively contain recesses so that the connection between the upper and the strips renders the components flush.

10 Claims, 24 Drawing Figures

Figure 1:
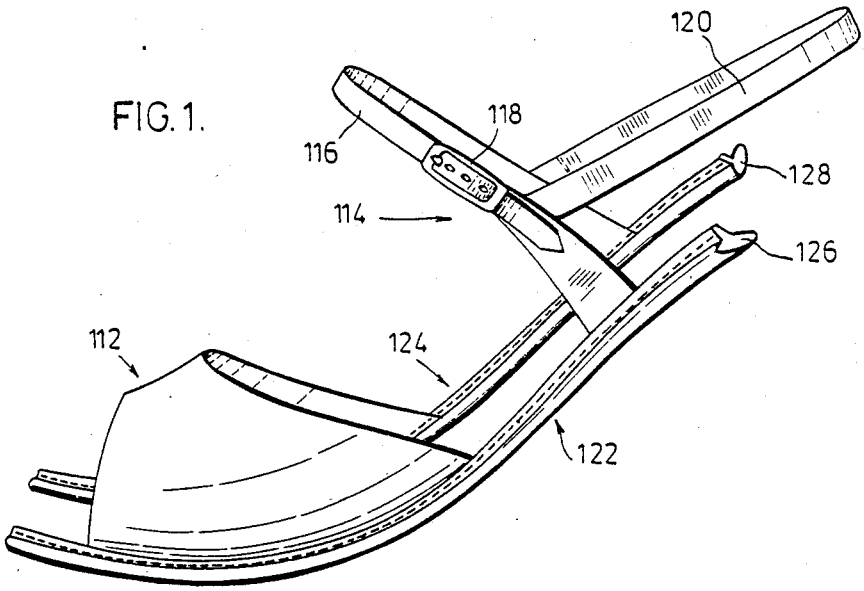

FIG. 5.
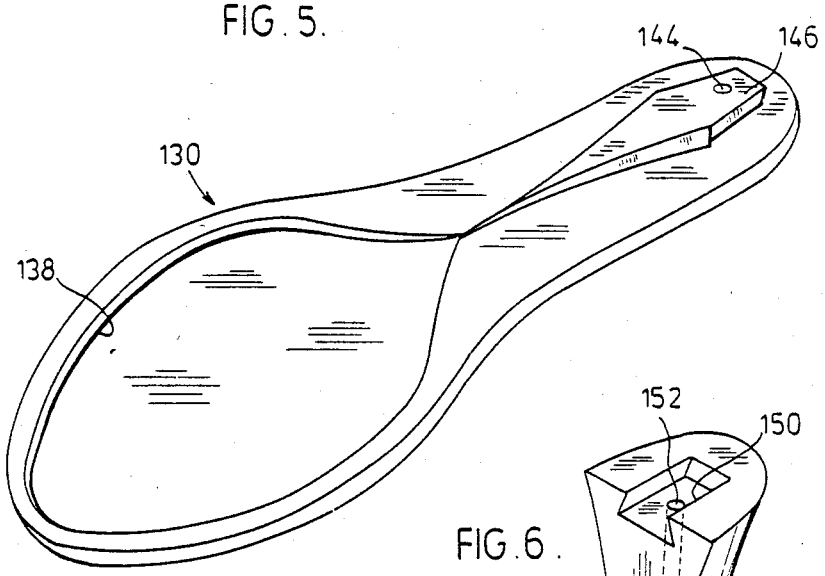
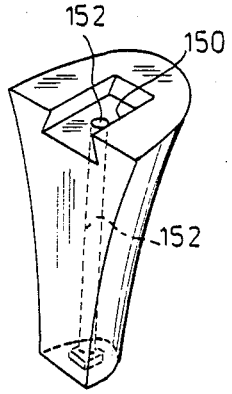
FIG. 6.
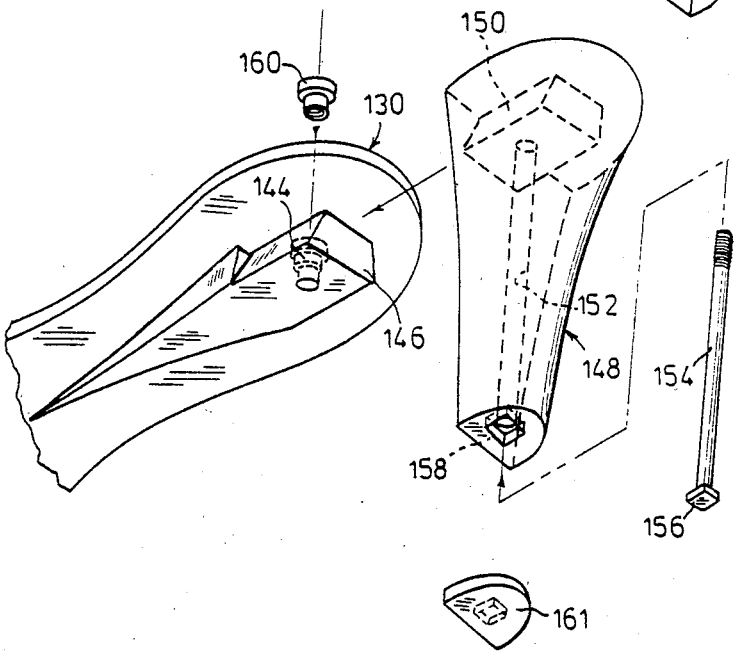
FIG. 7.

FIG. 9:
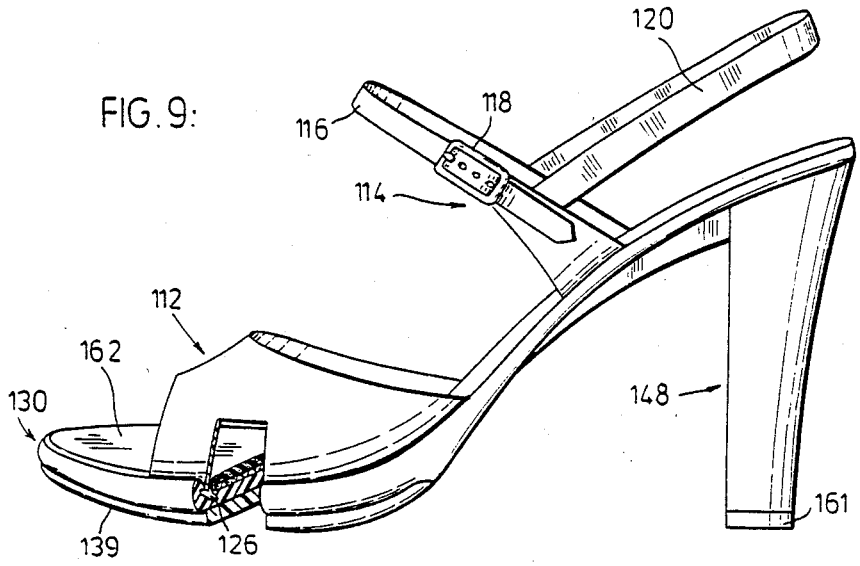
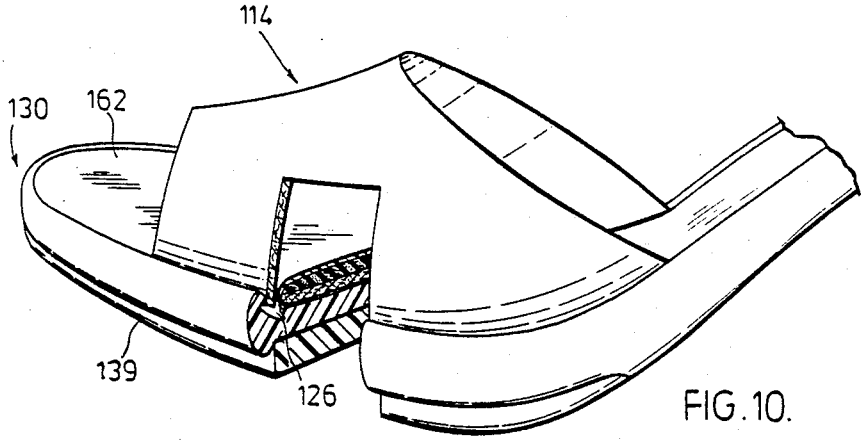
FIG. 10.

METHOD OF MAKING FOOTWEAR

The application is a continuation-in-part of application No. 148,611 filed May 12, 1980 now U.S. Pat. No. 4,343,057 issued Aug. 10, 1982, which is a continuation-in-part of application No. 100,586, filed Dec. 5, 1979, now U.S. Pat. No. 4,326,313, issued Apr. 27, 1982.

The present invention relates to a method of making articles of footwear and to articles of footwear made thereby.

Basic principles of construction of articles of footwear have remained the same for a number of years, the only significant changes being concerned with the replacement of skilled workers by complicated machinery. Such machinery is not only expensive in initial cost, but also requires a considerable amount of maintenance with the consequent cost not only of repair but also of lost production. Further it is difficult to find a sufficient number of skilled workers to carry out conventional techniques of footwear manufacture.

It is therefore an object of the invention to provide a method of making footwear which reduces the need for complicated machinery or highly skilled workers.

According to the invention, a method of making an article of footwear includes providing a preformed forward upper part and a preformed rear upper part, each upper part having a pair of laterally spaced lower edge portions, attaching a first connecting strip to the edge portions of the forward and rear upper parts on one side thereof, attaching a second connecting strip to the edge portions of the forward and rear upper parts on the opposite side thereof, providing a preformed sole unit with a recess adjacent each side thereof and shaped to receive a respective connecting strip, and assembling the upper parts with the sole unit by positioning the connecting strips in the recesses by movement in a direction substantially perpendicular to the length of the connecting strips and securing the connecting strips in the recesses.

The present invention thus requires the provision of various preformed units which can be assembled to produce articles of footwear by relatively unskilled workers without the necessity for complicated machinery.

The present invention thus also provides an article of footwear comprising a preformed forward upper part and a preformed rear part, each upper part having laterally spaced lower edge portions, a first connecting strip attached to the edge portions of the forward and rear upper parts on one side thereof, a second connecting strip attached to the edge portions of the forward and rear upper parts on the opposite side thereof, and a preformed sole unit having a recess adjacent each side thereof in which a respective connecting strip has been secured and has been positioned by movement of the connecting strip into the recess in a direction substantially perpendicular to the length of the connecting strip, the first and second connecting strips being on opposite sides of the sole unit to position the forward and rear upper parts thereon.

The sole unit may have recesses laterally inwardly spaced from each side thereof. Alternatively, each recess is open at the side of the sole unit.

The connecting strips may have recesses in their outer side edges receiving the forward and rear upper parts to render the upper parts flush with the side edges of the connecting strips. Alternatively, or additionally, the connecting strips may have recesses on an upper or lower surface adjacent the outer side edges receiving the forward and rear upper parts to render the upper parts flush with said surfaces.

Figure 2:
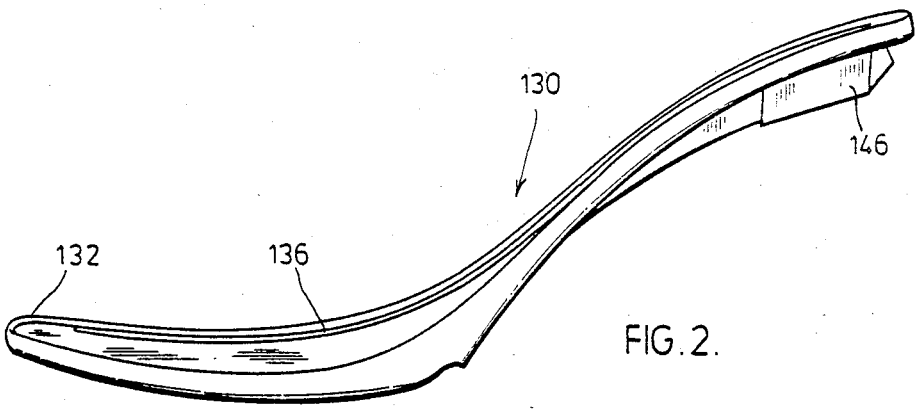
Figure 3:
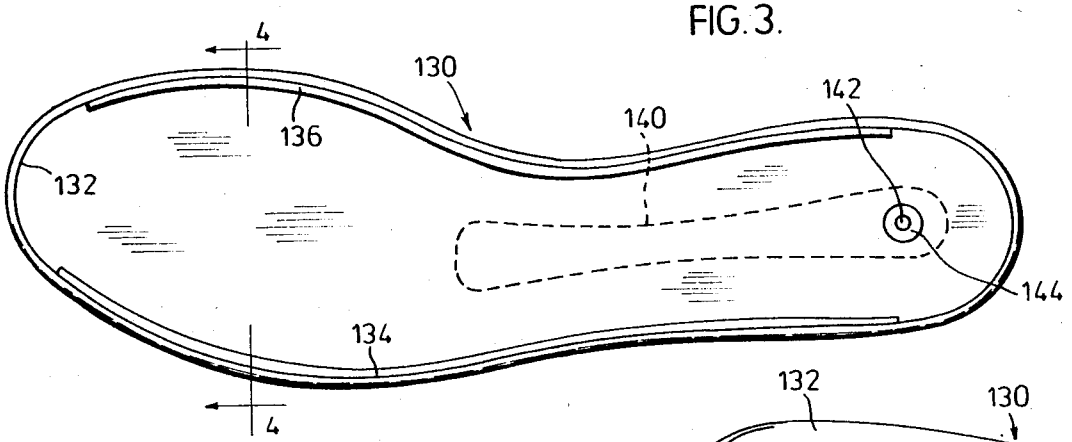
Figure 4:
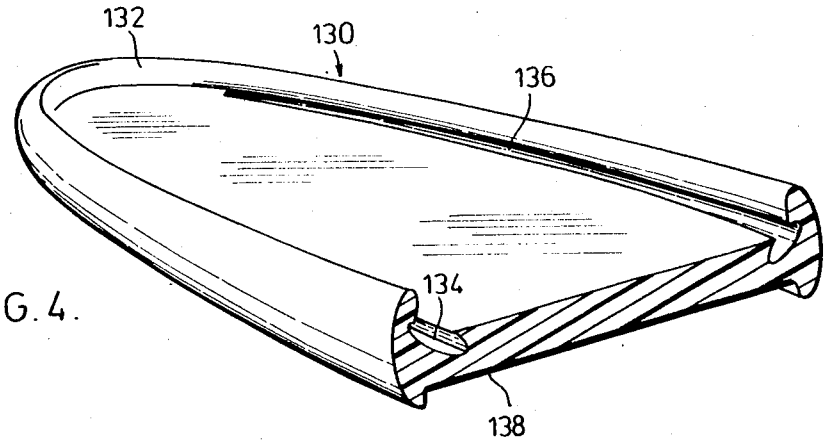
Figure 8:
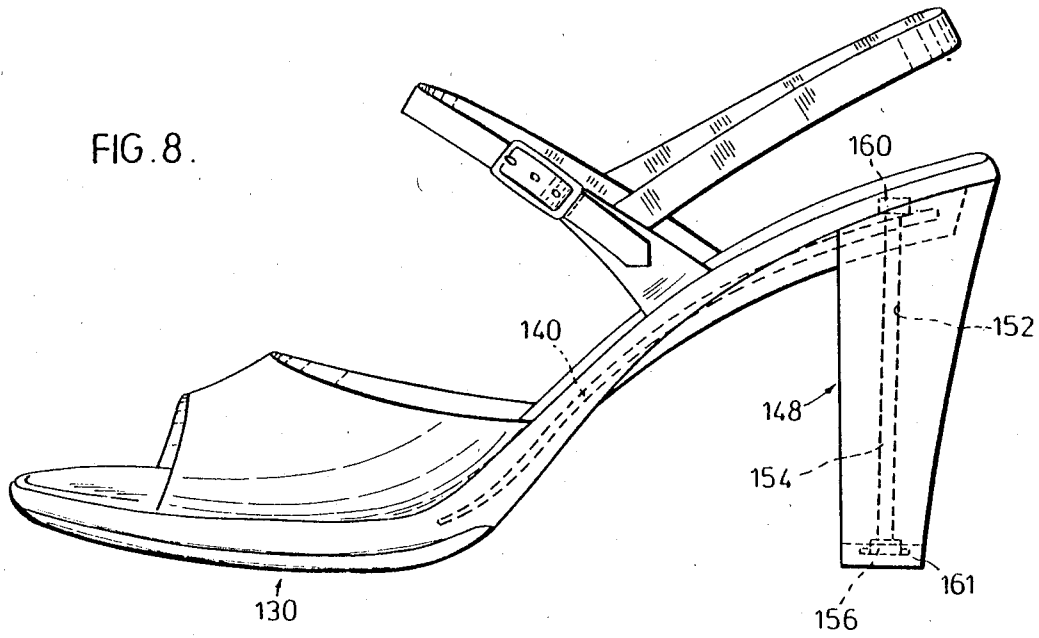
Figure 11:
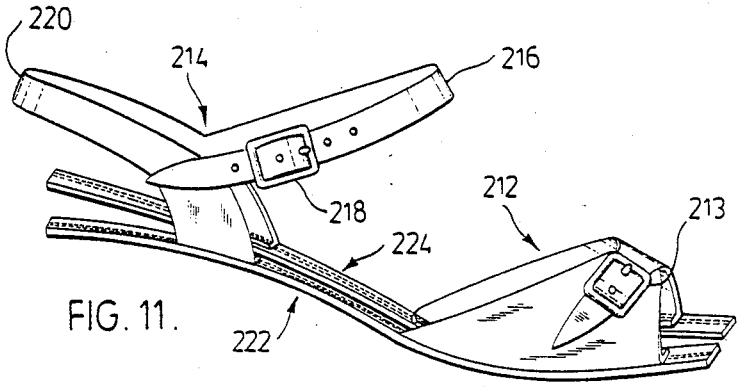
Figure 12:
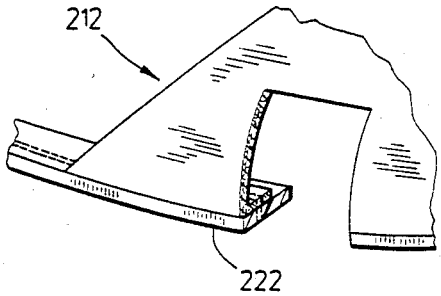
Figure 13:
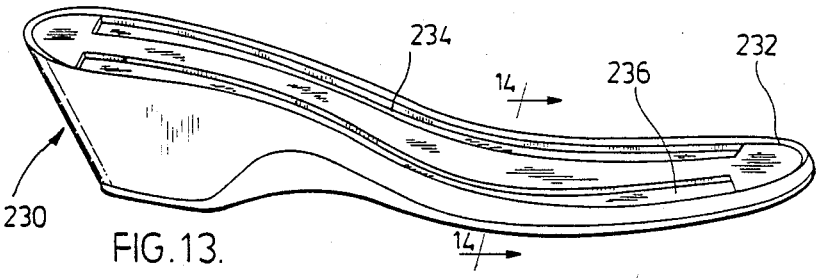
Figure 14:
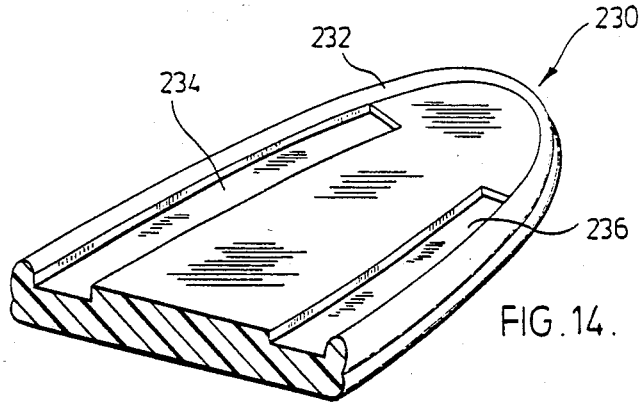
Figure 15:
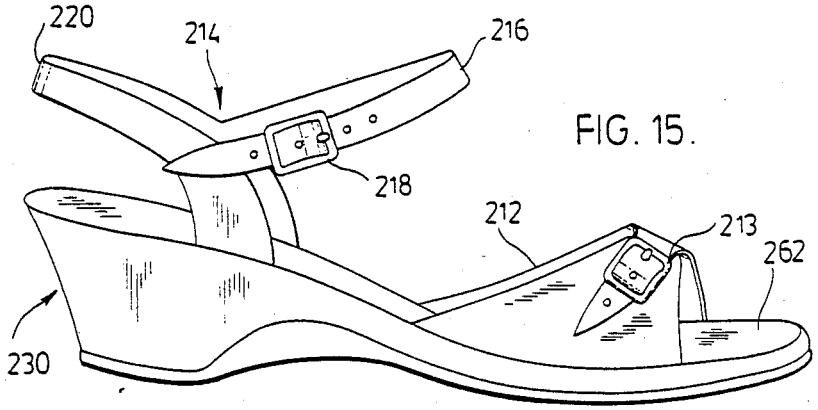
Figure 16:
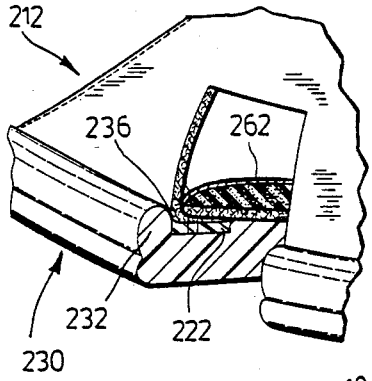
Figure 17:
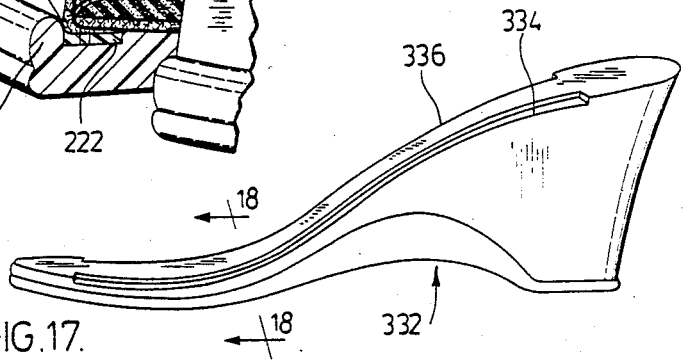
Figure 18:
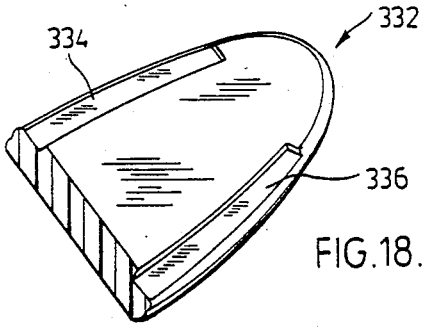
Figure 19:
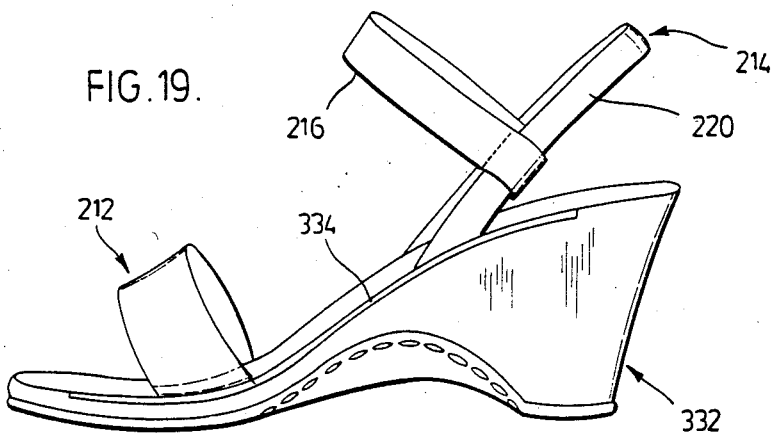
Figure 20:
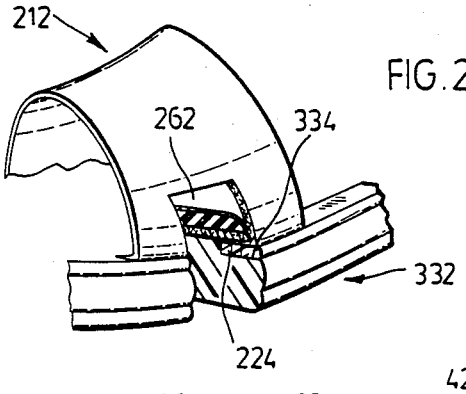
Figure 21:
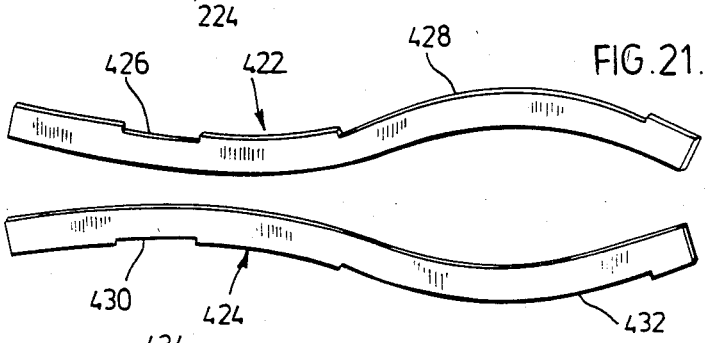
Figure 22:
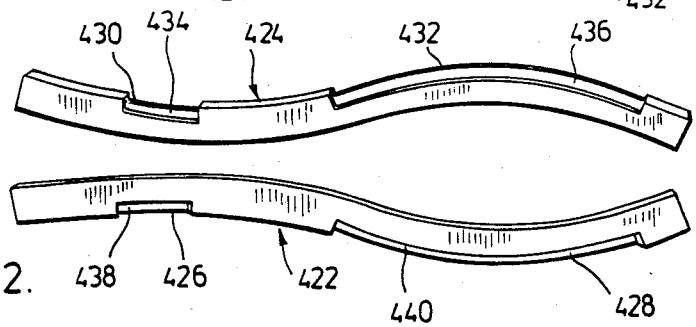
Figure 23:
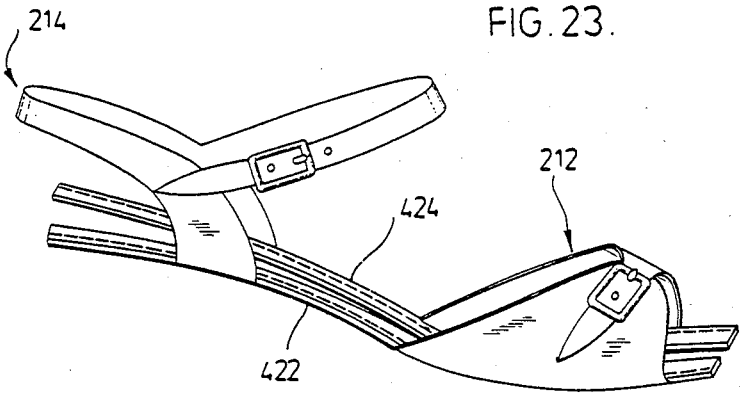
Figure 24:
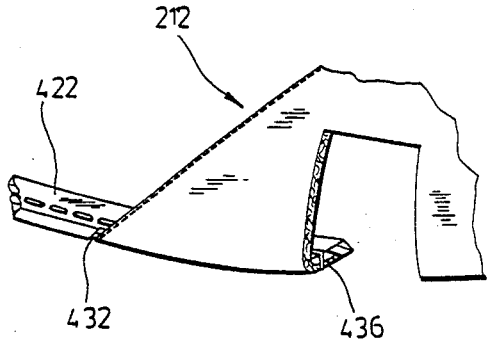

The embodiments of the invention will now be described, by way of example, with reference to the accompanying drawings, of which:

FIG. 1 is a side view of preformed forward and rear upper parts with connecting strips attached thereto in accordance with one embodiment, FIG. 2 is a side view of a sole unit attachable to the connecting strips of FIG. 1, FIG. 3 is a plan view of the sole unit, FIG. 4 is a sectional view of the sole unit taken along the line 4—4 of FIG. 3, FIG. 5 is a bottom view of the sole unit, FIG. 6 is a perspective view of a heel unit attachable to the sole unit, FIG. 7 is an exploded view showing the manner in which the heel is attachable to the sole unit, FIG. 8 is a side view of a completed shoe, FIG. 9 is a perspective view of the completed shoe, FIG. 10 is an enlarged view, partly broken away of the forward end of the completed shoe, FIG. 11 is a side view of preformed forward and rear upper parts with connecting strips attached thereto in accordance with a further embodiment, FIG. 12 is a side view, partly broken away, of part of FIG. 11, FIG. 13 is a side view of a preformed sole unit, FIG. 14 is a sectional view of the sole unit along the line 14—14 of FIG. 13, FIG. 15 is a side view of the completed shoe, FIG. 16 is a side view, partly broken away, of part of FIG. 15, FIG. 17 is a side view of a sole unit in accordance with another embodiment, FIG. 18 is a sectional view along the line 18—18 of FIG. 17, FIG. 19 is a side view of a completed shoe including the sole unit of FIGS. 17 and 18, FIG. 20 is a side view, partly broken away, of part of FIG. 19, FIG. 21 is a plane view of a pair of connecting strips in accordance with a further embodiment, FIG. 22 is a bottom view of the strips of FIG. 21, FIG. 23 is a side view of preformed forward and rear upper parts with the connecting strips of FIG. 21 attached thereto, and FIG. 24 is a side view, partly broken away of part of FIG. 23.

Referring to the drawings, FIGS. 1 to 10 show an embodiment of the invention which is especially useful with ladies' high heel dress or casual sandals or open toe or open heel shoes. In this embodiment, a shoe has a preformed forward upper part 112 and a preformed rearward upper part 114, these upper parts being of leather or suitable man-made material. In use, the forward upper part 112 extends across the forward upper part of the foot rearwardly of the toes, and the rear upper part 114 is in the form of a strap 116 with buckle 118 which extends across the rear part of the foot and a strap 120 which extends around the heel from one side to the other.

Two connecting strips 122, 124 of, for example, thermoplastic rubber each have a profiled section forming a projecting extension 126, 128 respectively. The first connecting strip 122 is connected by sewing to the lower edges of the forward upper part 112 and rear upper part 114 on one side thereof, and the second connecting strip 124 is similarly connected on the opposite side, such that the rear upper part 114 is rearwardly spaced from the forward upper part 112.

A preformed sole unit 130 in the form of a platform member is made of a rigid molded plastic material such as styrene. The sole unit 130 has a peripheral wall 132 extending completely around its upper surface. and longitudinally extending recesses 134, 136 at the junction of the peripheral wall 132 and the upper surface of the sole unit on opposite sides thereof, the recesses 134, 136 extending from a position near the front end of the sole unit to a position near the rear end thereof. Recesses 134 and 136 are shaped to enable the projecting extensions 126, 128 of the connecting strips 122, 124 respectively to be snapped into engagement therewith.

The underside of the front end of the sole unit 130 has a recess 138, as shown in FIGS. 4 and 5, into which a preformed sole pad insert 139 is secured by suitable adhesive at this stage, the sole insert 139 being shown in FIGS. 8, 9 and 10.

The connecting strips 122, 124 can be readily be snapped into engagement with the recesses 134, 136 in the sole unit 130, as indicated in FIGS. 8, 9 and 10, by movement of the connecting strips 122, 124 into the recesses 134, 136 in a direction perpendicular to the length, and the engaging surfaces may be previously treated with adhesive to form a more secure connection if desired.

The sole unit 130 has a longitudinal preformed steel reinforcing spine 140 positioned therein during manufacture, the spine 140 extending over the rear part of the sole unit 130 as shown in FIGS. 3 and 8. Near its rear end, the shank 140 has an aperture 142 which is aligned with a vertical bore 144 in the sole unit 130. The underside of the rear end part of the sole unit 130 has an integral tenon portion 146 of a mortice and tenon joint, with the bore 144 extending therethrough. A preformed heel 148 of rigid molded plastic material such as styrene, shown in FIG. 6, has an upper surface with the mortice portion 150 of the joint and a bore 152 extending therethrough from the upper surface to the bottom surface of the heel 148.

The heel 148 is assembled with the sole unit 130 by sliding the mortice portion 150 of the heel 148 forwardly into engagement with the tenon portion 146 on the sole unit. A bolt 154 with a head 156 is passed upwardly through the heel 148 so that the head 156 sits in a correspondingly shaped recess 158 in the bottom of the heel 148. A nut 160 is then screwed onto the threaded end of the bolt 154, whose length is such that the nut 160 is positioned in the upper end of the bore 144 in the sole unit, the upper end being countersunk for this purpose. A heel top-lift 161 is then secured to the bottom of the heel 148 in the usual way.

Finally, a light insole 162 is secured by adhesive to the upper surface of the sole unit 130 within the peripheral wall 132, as indicated in FIGS. 9 and 10. The insole 162 preferably comprises foam cushion material with a covering of leather of suitable man-made material.

FIGS. 11 to 16 show another embodiment in which a lady's shoe has a preformed forward upper part 212 and a preformed rear upper part 214 similar to the forward and rear upper parts 112 and 114 of the previous embodiment. The forward upper part 212 in this case is in two portions connected by a buckle 213 and the rear upper part 214 comprises a first strap 216 with buckle 218 and a second strap 220.

In this embodiment however, the connecting strips 222, 224 are flat strips of flexible material with rectangular section, for example thermoplastic rubber or polyurethane strip. The first connecting strip 222 is connected by stitching to the inwardly turned lower edges of the forward upper part 212 and rear upper part 214 on one side thereof, and the second connecting strip 224 is similarly connected on the opposite side, such that the rear upper part 214 is rearwardly spaced along the length of the connecting strips 222, 224 on the forward upper part 212.

The preformed sole unit 230 has a peripheral wall 232 extending completely around its upper surface, and has longitudinally extending recesses 234, 236 at the junction of the peripheral wall 232 and the upper surface of the sole unit on opposite sides thereof, the recesses 234, 236 extending from a position near the front end of the sole unit to a position near the rear end thereof. The recesses 234, 236 are of rectangular section corresponding to that of the connecting strips 222, 224.

The forward and rear upper portions 212, 214 are readily assembled with the preformed sole unit 230 by applying a suitable adhesive to the lower surfaces of the connecting strips 222, 224 and/or the bottom surfaces of the recesses 234, 236 and fitting the connecting strips 222, 224 into the recesses 234, 236 by downward movement of the connecting strips into the recesses in a direction substantially perpendicular to the length. The depth of the recesses 234, 236 is the same as the thickness of the connecting strips 222, 234 so that the connecting strips are a flush fit in the recesses.

Finally, a light insole 262 is secured to the upper surface of the sole unit 230 within the peripheral wall 232, as shown in FIGS. 15 and 16. As in the previous embodiment, the insole 262 preferably comprises foam cushion material with a covering of leather or suitable man-made material.

In a further embodiment shown in FIGS. 17 to 20, a sole unit 332 is provided which does not have the peripheral wall of the previous embodiment, so that the recesses 334, 336 are open at the sides of the sole unit 332. Forward upper part 212, rear upper part 214 and connecting strips 222, 224 are the same as in the previous embodiment. The light insole 262 may also be included in this embodiment.

FIGS. 21 to 24 show a further embodiment in which connecting strips 422, 424 have recesses 426, 428 and 430, 432 respectively in their outer side edges to receive the preformed forward and rear upper parts 212, 214. The connecting strips 422, 424 also have recesses 434, 436 and 438, 440 respectively in their bottom surfaces adjacent the side edges for the same purpose. Thus, as shown in FIGS. 23, 24, the forward and rear upper parts 212, 214 are flush with both side edges and bottom surfaces of the connecting strip 442, 424. Recesses 434, 436 and 438, 440 may of course alternatively be provided in the upper surfaces of the connecting strips.

Other embodiments within the scope of the invention will be readily apparent to a person skilled in the art, the scope of the invention being defined in the appended claims.

What I claim as new and desire to protect by Letters Patent of the United States is:

1. A method of making an article of footwear including providing a preformed forward upper part and a preformed rear upper part, each upper part having a pair of laterally spaced lower edge portions, attaching a first connecting strip to the edge portions of the forward and rear upper parts on one side thereof, attaching a second connecting strip to the edge portions of the forward and rear upper parts on the opposite side thereof, providing a preformed sole unit with a recess adjacent each side thereof and shaped to receive a respective connecting strip by movement in a direction substantially perpendicular to the length of the connecting strip without deformation thereof, and assembling the upper parts with the sole unit by positioning the connecting strips in the recesses by movement in said direction and securing the connecting strips in the recesses.

2. A method according to claim 1 comprising providing each said recess at a location which is laterally inwardly spaced from each side of the sole unit.

3. A method according to claim 1 comprising providing each said recess at the side of the sole unit so that said recess is open at said side of the sole unit.

4. A method according to claim 1 comprising providing the connecting strips with recesses in their outer side edges which receive the forward and rear upper parts to render the upper parts flush with the side edges of the connecting strips.

5. A method according to claim 1 comprising providing the connecting strips with recesses on an upper or lower surface adjacent the outer side edges which receive the forward and rear upper parts to render the upper parts flush with said surfaces.

6. An article of footwear comprising a preformed forward upper part and a preformed rear part, each upper part having laterally spaced lower edge portions, a first connecting strip attached to the edge portions of the forward and rear upper parts on one side thereof, a second connecting strip attached to the edge portions of the forward and rear upper parts on the opposite side thereof, and a preformed sole unit having a recess adjacent each side thereof in which a respective connecting strip has been secured, said recess being shaped to receive the connecting strip without deformation thereof by movement of the connecting strip into the recess in a direction substantially perpendicular to the length of the connecting strip, the first and second connecting strips being on opposite sides of the sole unit to position the forward and rear upper parts thereon.

7. An article of footwear according to claim 6 wherein each recess is laterally inwardly spaced from each side of the sole unit.

8. An article of footwear according to claim 6 wherein each recess is open at the side of the sole unit.

9. An article of footwear according to claim 6 wherein the connecting strips have recesses in their outer side edges receiving the forward and rear upper parts to render the upper parts flush with the side edges of the connecting strips.

10. An article of footwear according to claim 6 wherein the connecting strips have recesses on an upper or lower surface adjacent the outer side edges receiving the forward and rear upper parts to render the upper parts flush with said surfaces.

* * * * *

UNITED STATES PATENT AND TRADEMARK OFFICE

CERTIFICATE OF CORRECTION

PATENT NO. : 4,586,209

DATED : May 6, 1986

INVENTOR(S) : Douglas W. Bensley

It is certified that error appears in the above-identified patent and that said Letters Patent is hereby corrected as shown below:

The term of this patent subsequent to August 10, 1999 has been disclaimed.

Signed and Sealed this

*Twelfth* Day of *August 1986*

[SEAL]

*Attest:*

DONALD J. QUIGG

*Attesting Officer*

*Commissioner of Patents and Trademarks*